United States Patent [19]

Sakata et al.

[11] 4,453,889

[45] Jun. 12, 1984

[54] STACKED ROTOR

[75] Inventors: Sooji Sakata; Haruo Miura, both of Ibaraki, Japan

[73] Assignee: Hitachi, Ltd., Tokyo, Japan

[21] Appl. No.: 407,628

[22] Filed: Aug. 12, 1982

[30] Foreign Application Priority Data

Aug. 19, 1981 [JP] Japan ..... 56/128753

[51] Int. Cl.[3] ..... F01D 5/06

[52] U.S. Cl. ..... 416/198 A; 416/201 R

[58] Field of Search ..... 416/198 A, 200 A, 201 R, 416/199, 200 R, 201 A, 198 R

[56] References Cited

U.S. PATENT DOCUMENTS

| | | | |
|---|---|---|---|
| 2,427,614 | 9/1947 | Meier | 416/201 |
| 2,650,017 | 8/1953 | Pedersen et al. | 416/201 X |
| 2,772,853 | 12/1956 | Woodworth | 416/198 A X |
| 2,798,383 | 7/1957 | Van Cleave | 416/144 X |
| 3,184,153 | 5/1965 | Zech et al. | 416/198 A |
| 3,749,516 | 7/1973 | Samurin et al. | 416/199 |
| 4,123,199 | 10/1978 | Shimizu et al. | 416/198 A X |
| 4,127,359 | 11/1978 | Stephan | 416/198 A |

FOREIGN PATENT DOCUMENTS

| | | | |
|---|---|---|---|
| 841663 | 6/1952 | Fed. Rep. of Germany | 416/198 A |
| 1284689 | 12/1968 | Fed. Rep. of Germany | 416/198 A |
| 2844746 | 4/1979 | Fed. Rep. of Germany | 416/201 R |
| 2329882 | 5/1977 | France | 416/201 R |

*Primary Examiner*—Everette A. Powell, Jr.

*Attorney, Agent, or Firm*—Antonelli, Terry & Wands

[57] ABSTRACT

A stacked rotor of an axial-flow type machine having a plurality of discs stacked in the axial direction and united into one body by stacking bolts, each of the discs being provided on the periphery thereof with a plurality of rotor blades. The portions of bolt holes in adjacent discs at the juncture of these discs are provided with opposing tapered surfaces. Each stacking bolt is supported by the discs through bolt deformation resisting members having an outer peripheral surface making close contact with the tapered surfaces of the bolt holes and an inner peripheral surface fitting around the stacking bolt.

9 Claims, 12 Drawing Figures

STACKED ROTOR

BACKGROUND OF THE INVENTION

The present invention relates to a rotor for an axial-flow type machine such as an axial compressor for industrial use, axial compressor of a gas turbine, steam turbine or the like and, more particularly, to a stacked rotor wherein a plurality of discs, each having radial rotor blades on its outer periphery, are stacked axially and joined to each other by stacking bolts.

Since that rotor blades of axial-flow type machines such as, for example, an axial compressor, are often damaged due to the drawing in of foreign matters or the like, the use of stacked rotor, composed of a plurality of discs axially stacked and joined to form one body, is quite advantageous in that the stacked rotor enables an easy removal and replacement of rotor blades on the outer periphery of the rotor. Additionally, the stacked rotor affords a reduction in weight of the rotor through a reduction in weight of each disc. The reduced weight of the rotor reduces the inertia of the rotor which, in turn, permits a reduction of power and, hence, the size of the driving motor. A typical conventional stacked rotor includes a plurality of discs stacked in axial direction, with each disc being provided with a plurality of rotor blades fitted in dove-tail grooves formed in the outer peripheral surface thereof. The axially stacked discs are joined to form one body by stacking bolts received in axially aligned bolt holes formed in each of the discs. The bolt holes include reamer holes reamed with a high precision and clearance holes formed by drilling, with the reamer holes and the clearance holes being arranged in an alternating fashion. During assembling of the rotor problems are encountered due to errors arising during fabrication of the discs such as, for example, too small of a gap between the stacking bolts and reamer holes, and, for this purpose, the clearance holes are arranged alternatingly with the reamed holes. However,with a rotor having a small axial length, it is possible to ream all bolt holes to leave only a small clearance between the bolts and holes, because in such a case the overall length of the bolt holes is sufficiently small.

Thus, in the conventional stacked rotor, it is necessary to take a trouble of reaming bolt holes for the stacking bolts at an extremely high precision. Particularly, the assembling of the stacked rotor having a long axial length is quite difficult if all of the bolt holes are reamer holes.

In the conventional stacked rotor in which the reamer holes and the clearance holes are arranged alternatingly, a considerably large gap is formed between the stacking bolt and the wall of the clearance hole. Therefore, the stacking bolt is subjected to bending stresses and is deformed radially outwardly by centrifugal forces generated by rotation of the rotor. A large axial tensile stress is formed in the stacking bolt for tightly fastening the discs. Consequently, a large composite stress, composed of the bending stress and the tensile stress, is generated in each stacking bolt; therefore, the stacking bolts are subjected to a danger of rupture by fatigue.

SUMMARY OF THE INVENTION

Accordingly, it is an object of the present invention to provide an improved stacked rotor which facilitates the formation of bolt holes for the stacking bolts without causing any increase of the bending stress generated in each stacking bolt.

Another object of the invention is to provide an improved stacked rotor which reduces the bending moments generated in the stacking bolt.

To these ends, according to the invention, there is provided a stacked rotor having a plurality of discs stacked in the axial direction, with each of the discs being provided at its outer periphery with a plurality of rotor blades. A plurality of stacking bolts are provided for joining discs to each other so as to form a single body. Tapered surfaces are formed in portions of inner peripheral surfaces of the bolt holes of adjacent discs at the juncture between these discs, with bolt deformation resisting members being provided each of which have an outer peripheral surface adapted to fit the tapered surfaces in the bolt holes of adjacent discs and an inner peripheral surface adapted to fit around the stacking bolt.

Other features, objects and advantages of the invention will become clear from the following description of the preferred embodiments when taken in connection with the accompanying drawings.

BRIEF DESCRIPTION OF THE DRAWINGS

FIGS. 4A to 7A and FIGS. 4B to 7B are vertical cross sectional views, respectively, and side elevational views of different examples of the bolt deformation resisting members.

DESCRIPTION OF THE PREFERRED EMBODIMENTS

Figure 1:
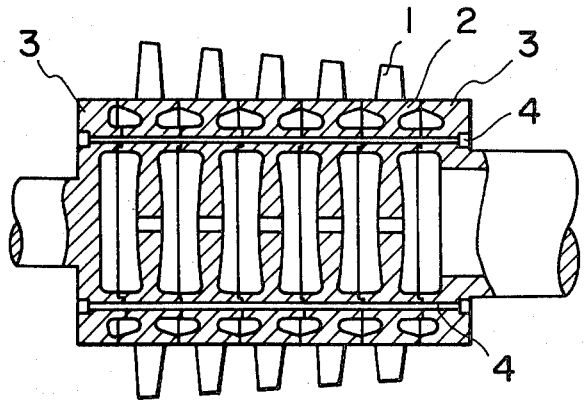
FIG. 1 is a vertical cross sectional view of a stacked rotor.
Figure 2:
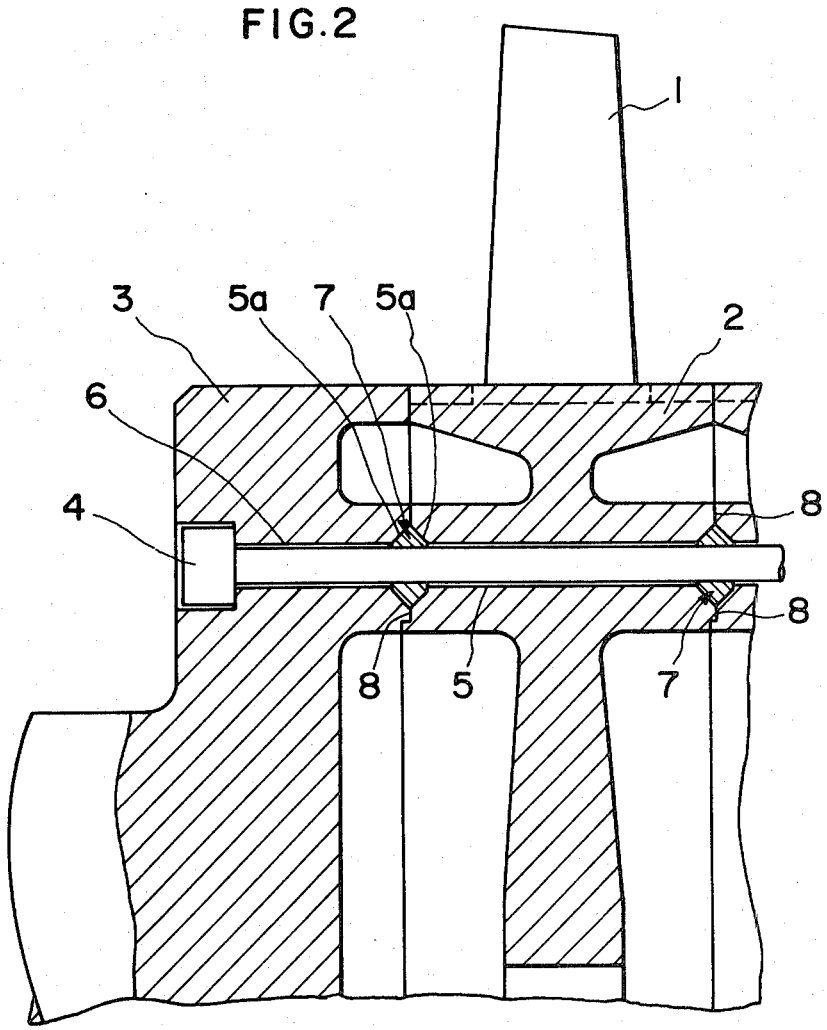
FIG. 2 is a vertical cross sectional detail view on an enlarged scale, of a stacked rotor constructed in accordance with an embodiment of the invention.
Figure 3A:
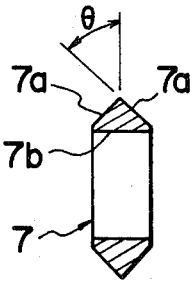
FIGS. 3A and 3B are a vertical cross sectional view and a side elevational view, respectively, of a bolt deformation resisting member incorporated in the stacked rotor shown in FIG. 2.
Figure 3B:
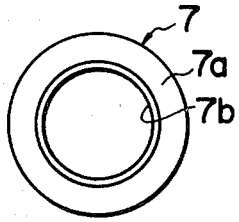

As shown in FIG. 1, a stacked rotor of an axial-flow machine includes a plurality of discs 2 having peripheral rotor blades 1 disposed thereon, with the discs 2 being stacked in an axial direction of the rotor. The discs 2 are joined to form a single body together with end pieces 3, disposed at both axial sides of the stacked discs 2, by a plurality of stacking bolts 4. As shown in FIG. 2, the stacking bolts 4 extend through bolt holes 5 formed in the discs, with bolt holes 5, formed by drilling, having a diameter somewhat greater than an outside diameter of the stacking bolt 4 so that a clearance 6 is formed between the outer peripheral surface of the stacking bolt 4 and the bolt hole 5 receiving the same. A bolt deformation resisting member 7 is disposed between the inner peripheral surfaces of the bolt holes 5 of adjacent two discs 2 and the outer peripheral surface of the stacking bolt 4 extending through the bolt holes 5, at the juncture 8 between the two adjacent discs 2. More specifically, a tapered surface **5*a* is formed on a portion of an inner periphery of the bolt hole 5 of each disc 2 facing the juncture 8 by a chamfering or the like. On the other hand, as shown in FIGS. 3A and 3B the deformation resisting member 7 has a through bore 7*b* for receiving the stacking bolt 4 and tapered peripheral surfaces 7*a*, with each of the surfaces 7*a*** being inclined at an angle $\theta$ to the vertical plane so as to make close contact with the tapered surfaces 5*a* in the bolt holes 5 of the two adjacent discs 2. Thus, each bolt deformation resisting member 7 has tapered outer peripheral surfaces 7*a* fitting the tapered surfaces 5*a* of the bolt holes 5 in adjacent two discs and an inner peripheral surface which closely fits around the stacking bolt 4. The bolt deformation resisting member 7 is made of a material such as, for example, brass, aluminum, or the like, having modules of elasticity smaller than that of the disc 2.

As the stacking bolts 4 are tightened, the discs 2 are compressed in the axial direction and, consequently, each bolt deformation resisting member 7 is pressed at its tapered outer peripheral surfaces 7*a* against the tapered surfaces 5*a* and against the stacking bolt 4. Thus, the stacking bolt 4 is strongly held by the disc 2 through the medium of the bolt deformation resisting member 7 so that the undesirable bending of the stacking bolt 4 is restricted even under the application of large centrifugal forces during operation of the axial flow machine, so that the level of the bending stress generated in the stacking bolt 4 is remarkably lowered. Additionally, since the bolt holes 5 in each disc 2 can be formed simply by drilling to have an inside diameter greater than the outside diameter of the stacking bolt, the process of production of the stacked rotor is advantageously simplified. Furthermore, since the bolt deformation resisting member 7 is made of a material having a modulus of elasticity smaller than that of the disc 2, the bolt deformation resisting member 7 can be brought into close and tight contact with the stacking bolt 4 by the pressure exerted on the tapered outer peripheral surfaces 7*a*.

Figure 4A:
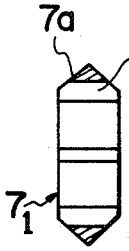
Figure 4B:
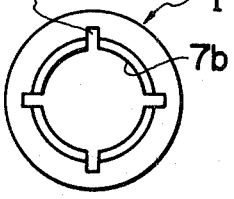
Figure 5A:
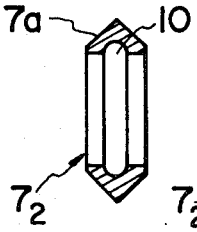
Figure 5B:
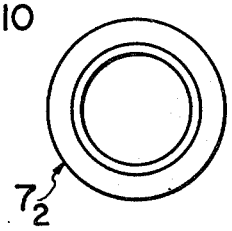
Figure 6A:
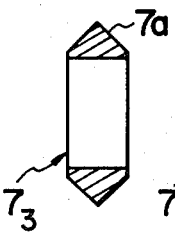
Figure 6B:
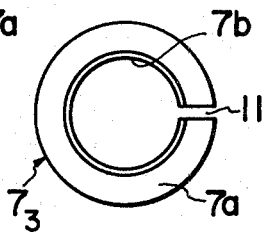
Figure 7A:
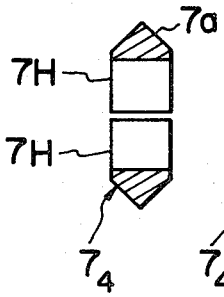
Figure 7B:
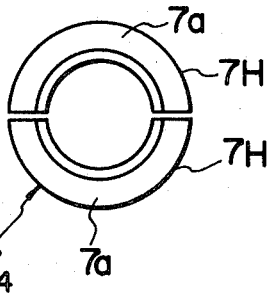

As shown in FIGS. 4A and 4B, a bolt deformation restricting member generally designated by the reference numeral $7_1$ may be provided with a plurality of circumferentially spaced axially extending grooves 9 in an inner peripheral surface thereof. It is also possible for a bolt deformation restricting member generally designated by the reference numeral $7_2$ to be provided with a circumferential groove 10 in an inner peripheral surface thereof as shown in FIGS. 5A and 5B or, as shown in FIGS. 6A and 6B, a deformation member generally designated by the reference numeral $7_3$ may be provided which includes a cut out portion 11 forming a disc continuity in a circumferential direction of the deformation member $7_3$. Additionally, a bolt deformation resisting member generally designated by the reference numeral $7_4$ may be provided which is composed of two segmental halves 7H.

In the examples shown in FIGS. 4A, 4B to FIGS. 7A, 7B the bolt deformation resisting member can easily be deformed in a radial direction so that the same can make closer and tighter contact with the stacking bolt 4, which, in turn, produces a greater resistance to the deformation of the stacking bolt 4.

As will be understood from the foregoing description, in the stacked rotor of the invention, the stacking bolts 4 are supported by discs 2 through the medium of bolt deformation resisting members 7, so that the bolt holes 5 can easily be formed by drilling to have a diameter somewhat greater than the diameter of the stacking bolt 4. The formation of the bolt holes 5, therefore, is simplified remarkably. Additionally, since the bolt holes 5 have an inside diameter somewhat greater than the diameter of the stacking bolt 4, it is possible to easily insert the stacking bolts 4 into the bolt holes 5, so that the assembling of the stacked rotor is advantageously facilitated.

What is claimed is:

1. A stacked rotor having a plurality of discs stacked in an axial direction of the rotor, a plurality of rotor blades provided on an outer periphery of each of said discs, a plurality of stacking bolts for joining said discs to each other to form a single body, bolt holes provided in each of said discs for accommodating the stacking bolts, each of said bolt holes including tapered surface portions formed along inner peripheral surfaces of adjacent discs at a juncture between said adjacent discs, and bolt deformation resisting members each having an outer peripheral surface adapted to fit said tapered surface portions in said bolt holes of adjacent discs and an inner peripheral surface adapted to closely fit around said stacking bolt.

2. A stacked rotor as claimed in claim 1, wherein said outer peripheral surface of said bolt deformation resisting member including tapered surfaces adapted to make close contact with said tapered surface portions of said bolt holes of adjacent discs.

3. A stacked rotor as claimed in one of claims 1 or 2, wherein said bolt deformation resisting member is made of a material having modulas of elasticity smaller than that of said disc.

4. A stacked rotor as claimed in one of claims 1 or 2, wherein said bolt deformation resisting member has a ring-like form.

5. A stacked rotor as claimed in claim 4, wherein said bolt deformation resisting member is provided in its inner peripheral surface with a plurality of axial grooves.

6. A stacked rotor as claimed in claim 4, wherein said deformation resisting member is provided in its inner peripheral surface with a circumferential groove.

7. A stacked rotor as claimed in claim 1, wherein said deformation resisting member is cut to form a circumferential discontinuity.

8. A stacked rotor as claimed in one of claims 1 or 2, wherein said deformation resisting member is composed of two complementary halves.

9. A stacked rotor having a plurality of discs stacked in the axial direction, each of said discs being provided at its outer periphery with a plurality of rotor blades; and a plurality of stacking bolts by which said discs are united into one body, wherein the improvement comprises tapered surfaces formed in the portions of inner peripheral surfaces of bolt holes of adjacent discs at the juncture between said adjacent discs, and bolt deformation resisting members each having an outer peripheral surface adapted to fit said tapered surfaces in said bolt holes of adjacent discs and an inner peripheral surface adapted to closely fit around said stacking bolt, said deformation resisting member being cut to form a circumferential disc continuity.

* * * * *